United States Patent [19]

Gallusser

[11] Patent Number: 4,850,898

[45] Date of Patent: Jul. 25, 1989

[54] ELECTRICAL CONNECTOR HAVING A CONTACT RETENTION

[75] Inventor: David O. Gallusser, Oneonta, N.Y.

[73] Assignee: Amphenol Corporation, Wallingford, Conn.

[21] Appl. No.: 756,477

[22] Filed: Jul. 18, 1985

[51] Int. Cl.[4] ..... H01R 13/44; H01R 13/40

[52] U.S. Cl. ..... 439/595; 439/271; 439/350

[58] Field of Search ..... 339/59 R, 59 M, 60 R, 339/60 M, 61 R, 61 M, 75 M, 94 M; 439/271, 282, 350, 359, 595

[56] References Cited

U.S. PATENT DOCUMENTS

| | | | |
|---|---|---|---|
| 2,419,018 | 4/1947 | Gudie | 173/328 |
| 3,838,382 | 9/1974 | Sugar | 339/59 R |
| 4,023,880 | 5/1977 | Powell | 339/59 R |
| 4,082,398 | 4/1978 | Bourdon et al. | 339/59 M |
| 4,387,943 | 6/1983 | Werth et al. | 339/59 R |
| 4,394,058 | 7/1983 | Frear | 339/59 R |
| 4,527,851 | 7/1985 | Gallusser et al. | 339/94 M |
| 4,636,020 | 1/1987 | Marmillion | 439/595 |
| 4,711,509 | 12/1987 | Cross et al. | 439/271 |

*Primary Examiner*—P. Austin Bradley
*Attorney, Agent, or Firm*—Bacon & Thomas

[57] ABSTRACT

A dielectric wafer 20 is sandwiched between a pair of dielectric inserts 12,16, each including an array of cylindrical passages 14,22,18 therethrough each being aligned to form a continuous through passage, each aligned array of passages receiving a cylindrical terminal 30 having a medial annular groove 34, the wafer including a plurality of fingers 24 which extend radially inward into its passage 22 to conformingly seat about the annular groove 34 whereby to retain the terminal within its respective passage.

10 Claims, 2 Drawing Sheets

FIG. 1
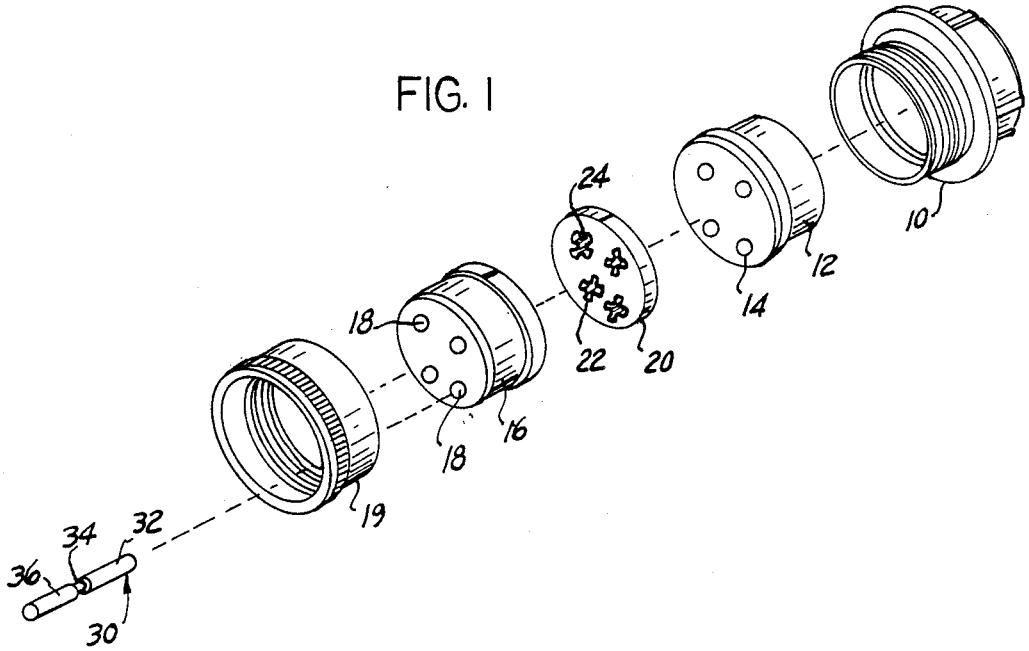
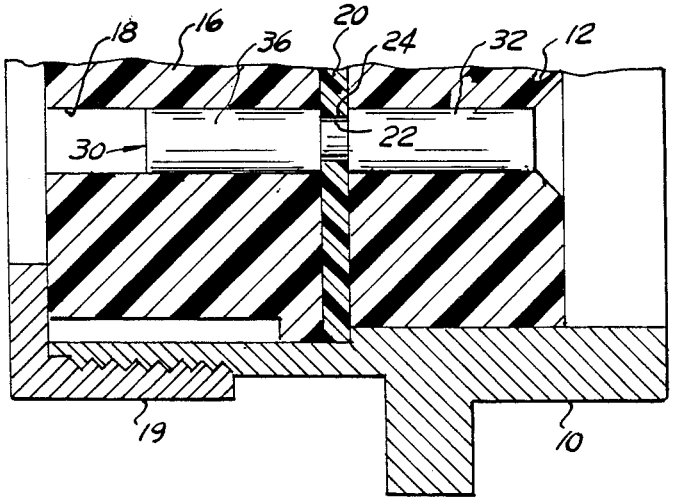
FIG. 2

FIG. 3
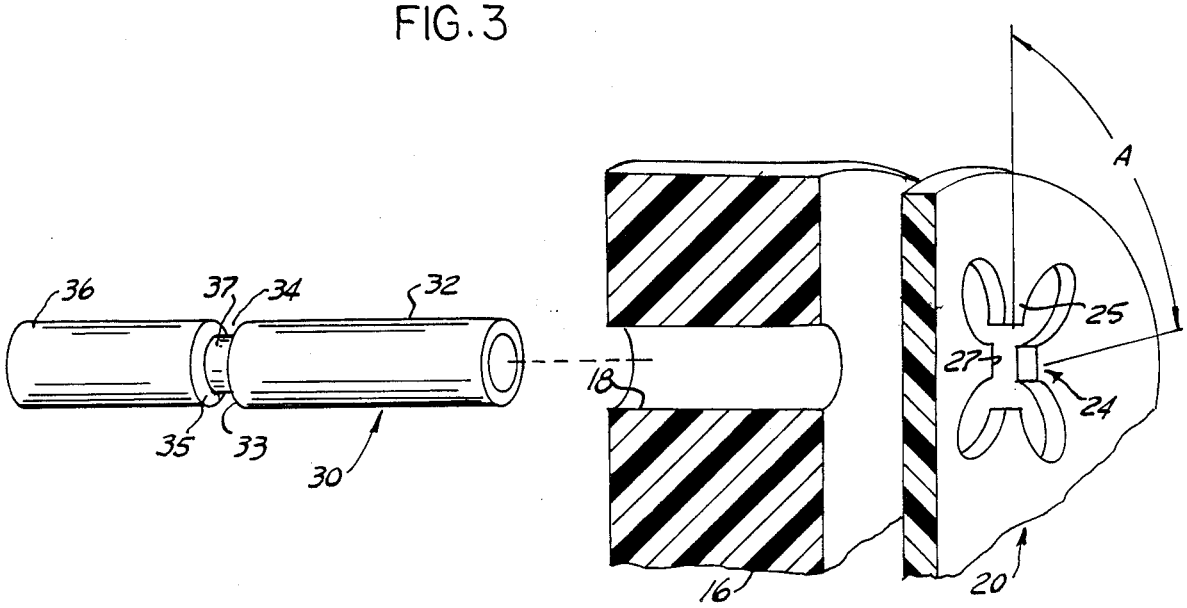
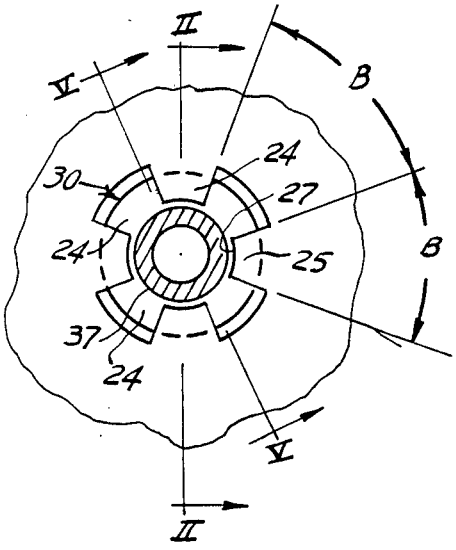
FIG. 4
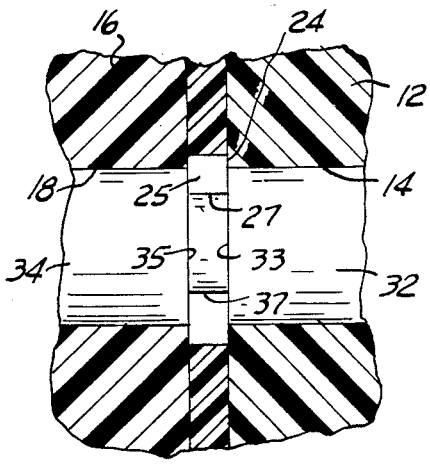
FIG. 5

ELECTRICAL CONNECTOR HAVING A CONTACT RETENTION

This invention relates to an electrical connector having a contact retention and more particularly to a dielectric wafer which captivates an electrical terminal being mounted within the connector.

Electrical connector assemblies generally include a plug and receptacle shell, each of which includes an insert of dielectric material provided with an array of axial passages within which electrical terminals are retained. These inserts may be stacked together so that an axial passage in each is aligned whereby to receive the electrical terminal and may provide for front or rear release of the terminals to facilitate servicing of the connector. Examples of electrical connectors having insertable and removable contacts maybe found in U.S. Pat. 3,165,369 entitled "Retention System For Electrical Contacts" issued July 12, 1966; 3,221,292 entitled "Electrical Connector" issued Nov. 30, 1965. In each of these patents, the terminals are retained within the connector shell by a retention mechanism.

In many retention arrangements, the terminal incudes an outward radial collar which is captivated between a fixed shoulder and slanted fingers from connector inserts. In some arrangements, space is critical and so the terminal must be quite small and standard retention approaches will not work.

This invention provides an electrical connector that has a contact retention arrangement which allows the contacts to be inserted and removed into the dielectric insert in either direction. In particular, a separate terminal retention wafer is sandwiched between a pair of dielectric inserts with an axial passage in each being aligned to receive a contact of the type having a medial annular groove, the wafer including a plurality of inward radial fingers which seat within the groove.

Accordingly, an advantage of this invention is provision of a contact retention for an electrical connector that combines a contact retaining function for miniature electrical terminals and insertswhile allowing forward and rearward mounting of a contact. By way of example the wafer passage diameter does not exceed in 0.092 inches, whereby to retain six 0.062 inch diameter contacts within a zone of 0.300 inch ×0.300 inch. An advantage of the separate wafer allows substitution of materials to permit exchange of different wafers having substantially stiff or resilient characteristics to enhance contact retention under differing load conditions placed on the terminal.

The foregoing and other features and advantages of the invention will be apparent from the following description of the invention as illustrated in the accompanying drawings:

FIG. 1 is an exploded assembly view of an electrical connector.

FIG. 2 is a cross-section of the assembled electrical connector.

FIG. 3 shows an electrical terminal positioned for retention by a dielectric wafer.

FIG. 4 shows the electrical terminal retained by the wafer.

FIG. 5 is a view taken along lines IV—IV of FIG. 4.

Referring now to the drawings, FIG. 1 is an exploded view of an electrical connector comprising a cylindrical shell 10, a plurality of cylindrical dielectric members 12,20,16 positioned for entry in the shell, each member having an array of cylindrical passages 14,22,18 extending axially therethrough and each adapted to be stacked in the shell so that each array of axial passages is aligned with one another, a nut 19 which threadably engages the shell for maintaining the dielectric members in the shell, and a cylindrical electrical terminal 30 positioned to be mounted in one of the aligned axial passages. The terminal includes a forward portion 32, a rearward portion 36, and a medial annular groove 34.

A retention arrangement for retaining the terminal in the shell includes the dielectric members including a flat, thin, cylindrical wafer 20 and a pair of elongated cylindrical inserts 12,16 with the wafer being sandwiched between the inserts and including a plurality of relatively rigid fingers 24 extending radially inward into each passage 22 of the wafer. Although shown best in FIGS. 5–6, each finger 24 terminates in a free end portion 25 which is adapted to seat in the annular groove 34 around the contact with the free end 27 of the finger being arcuate so as to conform to the annular periphery of the groove.

FIG. 2 shows a detailed view of the assembled connector. The nut 19 maintains the dielectric members in a side-by-side stacked relation. One continuous axial passage 14,22,18 extends between the inserts 12,16 and wafer 20, and the terminal 30 is captivated by the fingers 24 from the wafer seating in the annular groove 34. The terminal forward portion 32 and rearward portion 36 have a diameter sized to clearance fit in the passage of its respective insert. For front or rear insertion or removal of a terminal, the diameter of the forward and rearward portions of the terminal and that of the passage would be about the same.

FIG. 3 shows the terminal 30 about to enter the insert 16 for retention by the wafer. The wafer 20, as shown, includes four generally equiangularly separated, trangularly shaped, fingers 24, each disposed at a like angle "A", with each finger and the associated separation between fingers subtending substantially the same angle, shown as "B" in FIG. 4. While desirably four fingers are shown more or fewer could be used as desired. The wafer is comprised of a sturdy relatively rigid thermoplastic material such as Torlon or Ultem, each finger having enough- resilience to allow the contact to be passed therebetween.

The terminal 30 is generally cylindrical and the annular groove 34 is formed by a pair of faces 33,35 each of which is disposed in a plane substantially perpendicular to the primary axis of the terminal end and annular surface 37 extending generally concentrically between the faces.

FIG. 4 shows an end view of the terminal 30 in its mounted relationship in the wafer 20 wherein the free end portion 25 of each finger 24 is disposed within the annular groove, the free end 27 of the finger being arcuate and conforming substantially to the periphery of the annular surface 37 of the terminal to seat thereabout. While the fingers 24 and the angular separation therebetween are symmetrically arranged and equiangularly arranged by the amount "B", the angle subtended by the finger could be greater or lesser than that subtended by the separation.

FIG. 5 is a side view of the terminal 30 mounted in the wafer 20, particularly showing that the thickness (i.e. axial width) of the finger 24 of the wafer is generally the same as and fills the axial spacing between the faces 33,35 of the annular groove 34. FIG. 2, and the free end portions 25 of the fingers 24, is generally as would be seen taken along lines II—II of FIG. 5.

I claim:

1. In combination with an electrical connector of the type having a dielectric insert including an axial passage extending therethrough, a cylindrical electrical terminal having an annular groove defined by a first and a second face each being axially separated and being disposed in a plane generally perpendicular to the axis of said terminal and by an annular surface extending generally concentrically between the faces, and retention means for retaining the terminal in said passage, the improvement wherein said retention means includes a plurality of relatively stiff fingers each having one end immovably fixed to said insert and a free end extending radially inward into said passage and terminating about the annular surface, each respective pair of ends being coplanar and said finger having a thickness generally defined by the separation between said faces.

2. The invention as recited in claim 1 wherein said dielectric insert comprises a plurality of wafers each having a passage therethrough and stacked side-by-side so that the axial passage in each is aligned to form one continuous axial passage through the insert, one said wafer and each said finger of the insert being integrally formed.

3. The invention as recited in claim 2 wherein said dielectric insert is disposed in a shell and comprises three wafers, said one wafer being sandwiched between the other two wafers.

4. The invention as recited in claim 2 wherein said one wafer is generally flat and cylindrical in shape and includes two triangularly shaped fingers each being cantilevered equiangularly about and disposing the free end in the passage therethrough with each said finger having a pair of radial faces subtending an angle of less than 90° and the free end being arcuate so as to conform to the annular surface of the terminal groove.

5. An electrical connector comprising a shell, a plurality of dielectric members immovably stacked in the shell so that a respective axial passage through each is aligned with one another, means for maintaining the members in the shell, a cylindrical electrical terminal including a forward portion, a rearward portion and a medial annular groove, and retention means for retaining the terminal in the passage defined by said dielectric members, said retention means including a plurality of relatively rigid fingers each extending radially inward from a first end immovably secured to one said dielectric member and each terminating in a free end which is disposed in the annular groove and conforms to the periphery of the groove.

6. The electrical connector as recited in claim 5 wherein said annular groove comprises a pair of faces axially spaced each being disposed in a plane generally perpendicular to the primary axis of the terminal and an annular periphery extending concentrically between the faces with the end portion of each finger substantially filling the axial separation between the faces and the end of the finger conforming to the annular periphery of the groove.

7. The electrical connector as recited in claim 5 wherein an array of passages extend axially through the dielectric members each being configured to receive one said cylindrical electrical terminal.

8. The electrical connector as recited in claim 5 wherein the dielectric members include a flat thin wafer sandwiched between a pair of dielectric inserts, said fingers each extending from said wafer.

9. The electrical connector as recited in claim 8 wherein said wafer includes four equiangularly separated fingers with each finger and the associated separation between the fingers subtending substantially the same angle.

10. An electrical connector comprising a shell, a plurality of dielectric members immovably stacked in the shell so that a respective passage through each is aligned with one another to form one continuous axial passage therethrough, a cylindrical electrical terminal for mounting in the passage and including a forward portion, a rearward portion and a medial annular grove, and retention means for retaining the terminal in said passage, said passage defining a first inner wall and a second inner wall each respectively adapted to clearance fit about the forward portion and the rearward portion of the terminal, said retention means including a plurality of relatively rigid fingers each having one end immovably secured to one of the dielectric members and a free end extending radially inward therefrom to terminate in the annular groove, the one end and free end of each respective finger being coplanar.

* * * * *